US006910805B2

(12) United States Patent
Johnson

(10) Patent No.: US 6,910,805 B2
(45) Date of Patent: Jun. 28, 2005

(54) METHOD FOR SEALING ZIPPER ASSEMBLY TO BAG MAKING FILM AT THREE OR MORE POINTS

(75) Inventor: Joel L. Johnson, Stockbridge, GA (US)

(73) Assignee: Illinois Tool Works Inc., Glenview, IL (US)

( * ) Notice: Subject to any disclaimer, the term of this patent is extended or adjusted under 35 U.S.C. 154(b) by 13 days.

(21) Appl. No.: 10/261,480

(22) Filed: Sep. 30, 2002

(65) Prior Publication Data

US 2004/0062456 A1 Apr. 1, 2004

(51) Int. Cl.[7] ..... B65D 33/16

(52) U.S. Cl. ..... 383/61.2; 383/63; 383/64; 383/204

(58) Field of Search ..... 383/61.2, 203, 383/204, 63, 64

(56) References Cited

U.S. PATENT DOCUMENTS 5,023,122 A 6/1991 Boeckmann et al.
5,063,069 A * 11/1991 Van Erden et al. ..... 426/122
5,509,735 A * 4/1996 May ..... 383/210
5,660,479 A * 8/1997 May et al. ..... 383/204
6,138,439 A 10/2000 McMahon et al.
6,183,134 B1 * 2/2001 Malin ..... 383/210
6,354,738 B1 3/2002 Buckman et al.
6,517,242 B1 2/2003 Buchman
6,595,690 B2 * 7/2003 Machacek ..... 383/203

* cited by examiner

*Primary Examiner*—Jes F. Pascua
(74) *Attorney, Agent, or Firm*—Ostrager Chong Flaherty & Broitman P.C.

(57) ABSTRACT

A method for sealing a zipper assembly to bag making film at three or more points. The zipper assembly comprises a short zipper flange and a long zipper flange. The short flange is joined to one wall of the package while the long flange is joined to both walls of the package to define a product space in which the product is contained. Both the short and long zipper flanges are sealed to the bag making film at a first sealing station prior to folding of the film. After folding, the long zipper flange is sealed at one or more zones of joinder to the other side of the folded film. If the zipper assembly is attached in proximity to the fold line, then the second sealing operation is performed before filling and the bag is filled through the package bottom. If the zipper assembly is attached near the edge of the web of bag making film, then the second sealing operation is performed after the filling operation.

15 Claims, 6 Drawing Sheets

METHOD FOR SEALING ZIPPER ASSEMBLY TO BAG MAKING FILM AT THREE OR MORE POINTS

BACKGROUND OF THE INVENTION

This invention generally relates to slider-operated flexible zippers for use in reclosable pouches, bags or other packages of the type in which material, such as foodstuff, detergent, etc., may be stored.

Reclosable fastener assemblies are useful for sealing thermoplastic pouches or bags. Such fastener assemblies often include a plastic zipper and a slider. Typically, the plastic zippers include a pair of interlockable fastener elements, or profiles, that form a closure. As the slider moves across the profiles, the profiles are opened or closed. The profiles in plastic zippers can take on various configurations, e.g. interlocking rib and groove elements having so-called male and female profiles, interlocking alternating hook-shaped closure elements, etc.

Conventional slider-operated zipper assemblies typically comprise a plastic zipper having two interlocking profiles and a slider for opening and closing the zipper. In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled structures, portions of which form a fulcrum about which the profiled structures may be pivoted out of engagement when lower edges of the bases are forced towards each other by the moving slider.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged. This may readily be accomplished by forming a plastic bag of a film having the appropriate barrier properties. However, where the bag is provided with a zipper, a problem arises in properly sealing the bag at the opening to be closed by the zipper, since the zipper itself does not provide a hermetic seal.

A resealable package that exhibits tamper evidence and can be hermetically sealed is disclosed in U.S. Pat. No. 6,354,738. The invention disclosed therein makes use of a strip having capped perforations or another form of weakening in a unique bag configuration. A bag is provided having front and rear walls joined along the bottom and sides and open at the top. A zipper is provided at the bag top having first and second zipper halves that include interlocking profiled closure members designed to interlock with each other. Each zipper half comprises a respective flange, each flange extending from below the respective profiled closure member toward the bag interior. The flanges are of unequal size with the shorter flange being sealed directly to one (first) bag wall. The longer flange is sealed to the other (second) bag wall and to the first bag wall below the point at which the shorter flange is sealed to the first bag wall. A tear line, such as a capped line of perforations of the type disclosed in U.S. Pat. No. 5,023,122, is provided in the longer flange between the locations at which it is sealed to the two opposing bag walls. The capped line of perforations or other tear line weakens the zipper flange so that it may be readily ruptured, without detracting from the barrier property of the zipper flange until rupturing actually occurs.

FIG. 6 of U.S. Pat. No. 6,354,738 shows a zipper having a so-called "split flange", which name is derived from the fact that zippers of this tape can be manufactured by "splitting" a continuous web to form flanges. More specifically, such zipper tape is formed by extruding a pair of profiled closure members with a connecting membrane therebetween, forming a tear line near the center line of the connecting membrane, interlock the closure members and causing the connecting web to fold at the tear line, and then cutting or splitting the membrane on one side to form a short flange and a long flange, the latter having a generally V-shaped portion with the cusp at the tear line. Alternatively, the two zipper profiles of a split-flange zipper can be extruded separately, instead of being extruded as one piece and then cut. The split condition of the zipper flange results in faster and more consistent winding of the zipper on a spool as compared to the situation when the zipper has a continuous flange.

There is a need for a method of manufacturing the packages disclosed in U.S. Pat. No. 6,354,738, which discloses three-point sealing of the zipper, and other packages that employ four-point sealing of the zipper. Furthermore, during filling of resealable packages, it is important to avoid product contamination on the zipper flanges, which can result in poor seal quality of the finished product. In addition, it is important during sealing of the zipper flanges to the bag making film that the flanges not be sealed or tacked together. Also, in the case of resealable packages having a split-flange zipper, it is desirable that food product not become trapped behind the long zipper flange when the opened package is turned upside down and product is dispensed.

BRIEF DESCRIPTION OF THE INVENTION

The present invention is directed to improved resealable packages with split-flange zippers and to methods of manufacturing such improved resealable packages.

One aspect of the invention is a resealable package comprising: first and second walls; and a flexible zipper comprising first and second zipper parts that are mutually engageable to close the zipper and disengageable to open the zipper, the first zipper part comprising a first profiled closure element and a first flange having a first length, and the second zipper part comprising a second profiled closure element that is interlockable with the first closure element and a second flange having a second length greater than the first length, wherein a longitudinal portion of the first flange is joined to the first wall at a first seal, a first longitudinal portion of the second flange is joined to the first wall at a second seal, a second longitudinal portion of the second flange is joined to the second wall at a third seal, and a third longitudinal portion of the second flange is joined to the second wall at a fourth seal, the second seal being below the first seal, and the third seal being below the fourth seal.

Another aspect of the invention is a package comprising: a sheet of film folded along a fold line and sealed along at least portions of its unfolded edges to form a receptacle having a mouth and an interior, portions of the film proximal to the fold line forming a header that covers the mouth of the receptacle; a flexible zipper installed in the mouth of the receptacle, the zipper comprising one zipper part comprising a first profiled closure element and a first flange having a first length, and the other zipper part comprising a second profiled closure element that is interlockable with the first closure element and a second flange having a second length greater than the first length, wherein the first and second flanges extend into the interior of the receptacle, the first flange being joined to a first portion of the film disposed on one side of the fold line, and the second flange being joined to second and third portions of the film disposed on opposing sides of the fold line to define a product space; and product contained in the product space.

A further aspect of the invention is a package comprising: a sheet of film folded along a fold line and sealed along its unfolded edges to form a bag body having opposing walls and an interior; and a flexible zipper joined to opposing walls of film in proximity to the fold line, whereby a header space and a product space are formed in the bag body interior by joinder of the zipper and the opposing walls of film, the zipper comprising one zipper part comprising a first profiled closure element and a first flange having a first length, and the other zipper part comprising a second zipper part comprising a second profiled closure element that is interlockable with the first closure element and a second flange having a second length greater than the first length, wherein the first flange is joined to one wall of the bag body and the second flange is joined to both walls of the bag body in a manner that closes the product space.

Yet another aspect of the invention is a method of manufacturing a package, comprising the following steps: (a) placing a zipper assembly on a web of bag making film, the zipper assembly comprising first and second flanges, the second flange having a length greater than the length of the first flange; (b) joining a portion of the first zipper flange to the web of bag making film along a first zone of joinder; (c) joining a first portion of the second zipper flange to the web of bag making film along a second zone of joinder spaced apart from the first zone of joinder and generally parallel thereto; (d) folding the web of bag making film along a fold line that runs generally parallel to and is located in proximity to the assembly, the assembly being sandwiched between a first portion of the web of bag making film extending on one side of the fold line and a second portion of the web of bag making film extending on the other side of the fold line, the first and second zones of joinder being located on the first portion of the web of bag making film; (e) joining a second portion of the second zipper flange to the second portion of the web of bag making film along a third zone of joinder; (f) joining the first and second portions of the web of bag making film along fourth and fifth zones of joinder that begin at spaced apart sections of the fold line and run in parallel with each other and generally perpendicular to the fold line, the terminations of the fourth and fifth zones of joinder demarcating the ends of an open end of the receptacle thus formed; and (g) filling the receptacle with material via the open end.

Another aspect of the invention is a method of manufacturing a package, comprising the following steps: (a) placing a zipper assembly on a web of bag making film, the zipper assembly comprising first and second flanges, the second flange having a length greater than the length of the first flange; (b) joining a portion of the first zipper flange to the web of bag making film along a first zone of joinder; (c) joining a first portion of the second zipper flange to the web of bag making film along a second zone of joinder spaced apart from the first zone of joinder and generally parallel thereto; (d) folding the web of bag making film along a fold line that runs generally parallel to the assembly, the assembly being sandwiched between a first portion of the web of bag making film extending on one side of the fold line and a second portion of the web of bag making film extending on the other side of the fold line, the first and second zones of joinder being located on the first portion of the web of bag making film; (e) joining the first and second portions of the web of bag making film along third and fourth zones of joinder that begin at spaced apart sections of the fold line and run in parallel with each other and generally perpendicular to the fold line, the terminations of the third and fourth zones of joinder demarcating the ends of an open end of the receptacle thus formed; (f) filling the receptacle with material via the open end; and (g) joining a second portion of the second zipper flange to the second portion of the web of bag making film along a fifth zone of joinder after the filling step.

Other aspects of the invention are disclosed and claimed below.

DETAILED DESCRIPTION OF THE INVENTION

Figure 1:
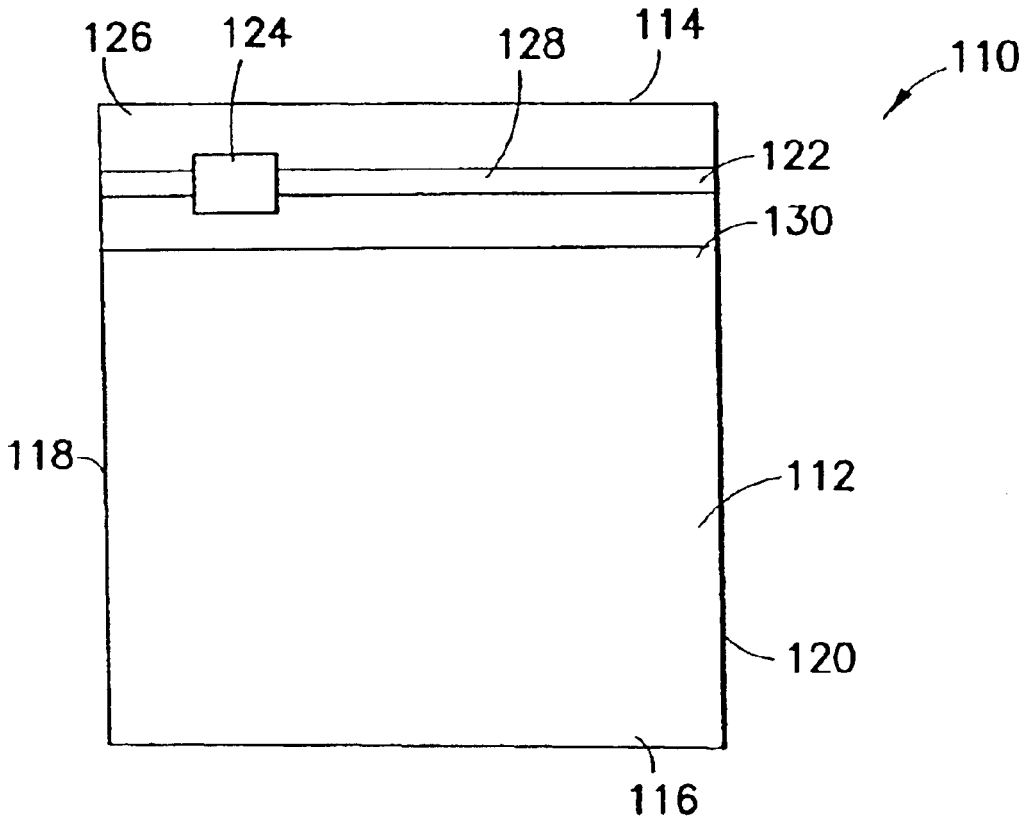
FIG. 1 is a drawing showing a front view of a typical resealable package having a slider/zipper assembly.

Reference will now be made to the drawings in which similar elements in different drawings bear the same reference numerals. FIG. 1 depicts a resealable package or bag 110 comprising a front wall 112 and a rear wall (not visible in FIG. 1) behind and opposite the front wall 112. The package further has a top 114, a bottom 116, and left and right sides 118, 120. In one type of package, the bottom 116 comprises a fold in the web material forming the front and rear walls and sides 118, 120 each comprise a side seal formed in the overlapping side edges of the front and rear walls. In another type of package, the bottom 116 comprises a bottom seal formed in the overlapping bottom edges of the front and rear walls and sides 118, 120 each comprise a side seal formed in the overlapping side edges of the front and rear walls. In yet another type of package, the bottom 116 comprises a bottom wall contiguous with the front and rear walls and sides 118, 120 each comprise a side seal as previously described. The front, rear and bottom walls comprise thermoplastic web material or film. The bag walls or walls may be formed of various types of thermoplastic material, such as low-density polyethylene, substantially linear copolymers of ethylene and a C3–C8 alpha-olefin, polypropylene, polyvinylidene chloride, mixtures of two or more of these polymers, or mixtures of one of these polymers with another thermoplastic polymer. The person skilled in the art will recognize that this list of suitable materials is not exhaustive. The preferred thermoplastic materials are polyethylene and polypropylene.

The side-sealed front and rear walls and the bottom 116 form a receptacle or pouch. The side-sealed uppermost portions of the front and rear body walls form a mouth of the receptacle. The resealable package shown in FIG. 1 further comprises a header 126, which may be a wall or strip formed from the same material as that comprising the walls of the package or from the same material as that comprising the zipper or from an entirely separate material. The header 126 encloses the mouth of the receptacle and acts as a tamper-evident feature. The header may also be used to provide a means for hanging the package on a hook on a display rack, e.g., by forming a hole in the header and sliding the hole onto a hook on a display rack. The package will then depend from the hook until removed by a consumer.

The thermoplastic web material of the front wall 112 and of the header 126 may be optically transparent, in which case a flexible zipper 122 and a slider 124, located inside of the package 110, will be visible, as seen in FIG. 1. Alternatively, the slider inside a package made of opaque material and having an enclosed header may be rendered visible my providing an aperture in one or both walls of the header. Typically the zipper 122 comprises two zipper halves that are heat sealed or bonded to the front and rear body walls respectively. Typically, one zipper half comprises an interlocking closure member (designated by numeral 128 in FIG. 1) having a male profile and the other zipper half comprises an interlocking closure member (not shown in FIG. 1) having a female profile designed to receive and interlock with the male interlocking member. Alternatively, the zipper may comprise alternating hook-shaped closure elements that interleave when the zipper halves are brought together. Each zipper half also comprises a flange or fin joined to the respective interlocking member. Typically, the flange 130 of one zipper half is sealed to the front body wall and the flange of the other zipper half (not shown in FIG. 1) is sealed to the rear wall.

The packaging depicted in FIG. 1 includes a slider 124 mounted on the zipper 122 to facilitate its opening and closing. To this end, moving the zipper slider toward one side disengages the profiled interlocking closure members of the zipper halves and moving the slider toward the opposite side brings the interlockable closure members of the zipper halves into engagement. The slider for opening or closing the reclosable zipper is typically shaped so that the slider straddles the zipper profiles. In a straddling slider, the ends of the slider are open to allow the zipper to pass through. The slider may be made in multiple parts and welded together or the parts may be constructed to be snapped together. The slider may also be of one-piece construction. The slider can be made using any desired method, such as injection molding. The slider can be molded from any suitable plastic, such as nylon, polypropylene, polystyrene, acetal, polyketone, polybutylene terephthalate, high-density polyethylene, polycarbonate, or ABS.

Figure 2:
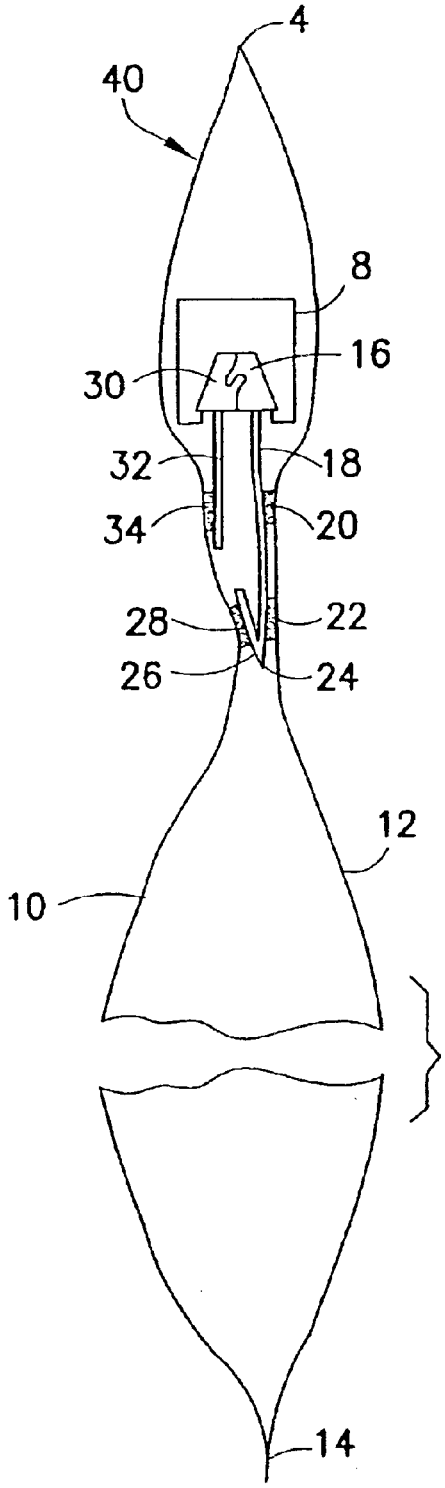
FIG. 2 is a drawing showing a sectional view of a resealable package in accordance with one embodiment of the invention.

A resealable package in accordance with one embodiment of the invention is shown in FIG. 2. The bag comprises a rear wall 10 and a front wall 12 integrally connected at a fold line 4 situated at the top of the package. At the bottom of the package, the opposing edges of walls 10 and 12 are joined by a fin seal 14. Although not shown in FIG. 2, the walls 10 and 12 are also joined at the sides of the package, at least from the bottom to the slider end stops on the zipper (not shown in FIG. 2) by respective side seals.

A zipper assembly 6 with a slider 8 is situated near the fold line 4 in the bag making film. The zipper assembly comprises first and second zipper parts that are mutually engageable to close the zipper and disengageable to open the zipper. The first zipper part comprises a profiled closure element 16 having a female profile and a long flange 18 connected to the closure element 16; the second zipper part comprises a profiled closure element 30 having a male profile and a short flange 32 connected to the closure element 30. The long and short flanges are formed by cutting a continuous web that has been extruded along with and is connected to the profiled closure members. Although the slider 8 is included in the disclosed embodiment, the slider is optional and is not necessary to practice the present invention.

As seen in FIG. 2, zipper flange 32 is secured to the bag rear wall 10 by a permanent seal 34 proximal to the top of the bag. Zipper flange 18, which is longer than flange 32, is secured to the bag front wall 10 by permanent seals 20 and 22 proximal to the bag top. Flange 18 is further secured to the bag rear wall 10 by a permanent seal 28, which is located below the seal 34. It should be appreciated that each of the seals 20, 22, 28 and 34 is a band of joined, e.g., fused, material that extends from one side seal of the bag to the other side seal, thereby securing the zipper to the bag along the width of the bag. In this disclosed embodiment, the seals 20 and 22 are generally parallel to each other, and the seals 28 and are generally parallel to each other. Also, seals 20 and 34 are generally opposed to each other at one elevation, and seals 22 and 28 are generally opposed to each other at a lower elevation.

The bag walls 10 and 12 are formed of a suitable plastic film material for the product to be contained within the package. For example, the film may be a laminate or coextrusion comprising a gas barrier layer and/or a low-melting-point sealant layer. The flange 18 may be formed by lamination, coextrusion or monolayer extrusion, and may comprise a barrier layer contained within tie (or adhesive) layers and low-melting-point sealant layers. In this manner, flange 18 and bag walls 10, 12 cooperate in maintaining a barrier completely around the product to permit the hermetic sealing of the product within the package. In addition, one of the internal or external layers of flange 18 may comprise a low-melting-point material to facilitate controlling the sealing of the flange to the bag walls as required. The low-melting-point sealant layers facilitate sealing the flange to the bag walls. The barrier layer may provide resistance to moisture and/or gases such as oxygen, carbon dioxide, nitrogen and other gases from entering (or exiting) the package and permits the package to be hermetically sealed if required. The hermetic sealing of the package contents is independent of the zipper and will be maintained whether the zipper is opened or closed as long as the bag walls and flange 18 remain intact.

The portion of the folded bag making film that covers the slider-zipper assembly functions as a header 40. The functions of the header include one or both of the following: (1) providing a means for suspending the package from a hook on a display rack; and/or (2) providing evidence of tampering to the consumer before a purchase is made. The sides of the header 40 may optionally be sealed at the same time that the package side seals are formed. In the case where the header is sealed at its side to form an enclosed space above the zipper, the space above the seals 20 and 34 and between the zipper assembly and the header walls will be referred to herein as the "header space". The space below the seals 22 and 28 and between the receptacle walls and the unruptured segment of flange 18 that spans seals 22 and 28 will be referred to herein as the "product space", i.e., the space containing the packaged product.

As indicated in FIG. 2, the long flange 18 has a tear line 24 that runs along the flange parallel to interlocking closure member 16. The terminal section 26 is that portion of flange 18 extending from the tear line 24 to the end of flange 18 that is sealed to wall 10. This portion will be separated from the remainder of flange 18 where the tear line 24 is ruptured. The tear line 24 may take the form of a scoreline in the flange or a line of contamination in the extruded thermoplastic material of the flange or any other form of weakened tear resistance along a line. Alternatively, the tear line may comprise a line of perforations (not shown in FIG. 2) extending along the flange 34. To maintain the barrier of flange 34, the line of perforations is capped by a frangible strip (not shown in FIG. 2) of lightweight material, as disclosed in U.S. Pat. No. 5,023,122. This frangible strip seals the perforations, but tears readily when the perforated flange is ruptured along the perforations. The sealing strip may be heat sealed to the perforated flange or the sealing strip may be adhesive backed to allow the strip to be bonded to the flange by adhesive. Alternatively, the sealing strip may be provided by extruding a thin layer of material over the perforations. The details of how to manufacture a sealing strip for capping perforations in a substrate are fully disclosed in U.S. Pat. No. 5,023,122, which is incorporated by reference herein.

After the header is removed by tearing along lines 42 and 44, and the zipper is initially opened by a consumer, the flange 18 still prevents access to the package contents. The intact flange 18 provides hermetic sealing. By bearing down on the flange 18 or simply separating the top ends of the bag, the tear line 24 can be ruptured, thereby providing access to the contents.

To facilitate opening of the package by the consumer, the tear line 24 may be provided midway between the seal points 22 and 28 of flange 18. In this regard, flange 18 may be formed into a generally V-shaped section as shown in FIG. 2 with the tear line 24 in the cusp of the V. The package may then readily be opened by the consumer simply running a finger along the cusp to rupture the tear line 24. However, if the package is subjected to high internal pressure, the tear line may be moved toward seal point 28, thereby providing a hinge effect enabling the tear line to withstand a greater internal force. In general, the four-point sealing of the zipper to the bag making film allows the manufacturer to control the amount of force required to rupture the weakened flange by varying the location of the sealing points. For example, for certain potentially toxic products, a greater degree of force to penetrate the tear line of the flange could be required, whereas nontoxic food products used daily by consumers could have a lower rupture force requirement, so that it is not overly difficult for the average consumer to access the product.

Figure 3:
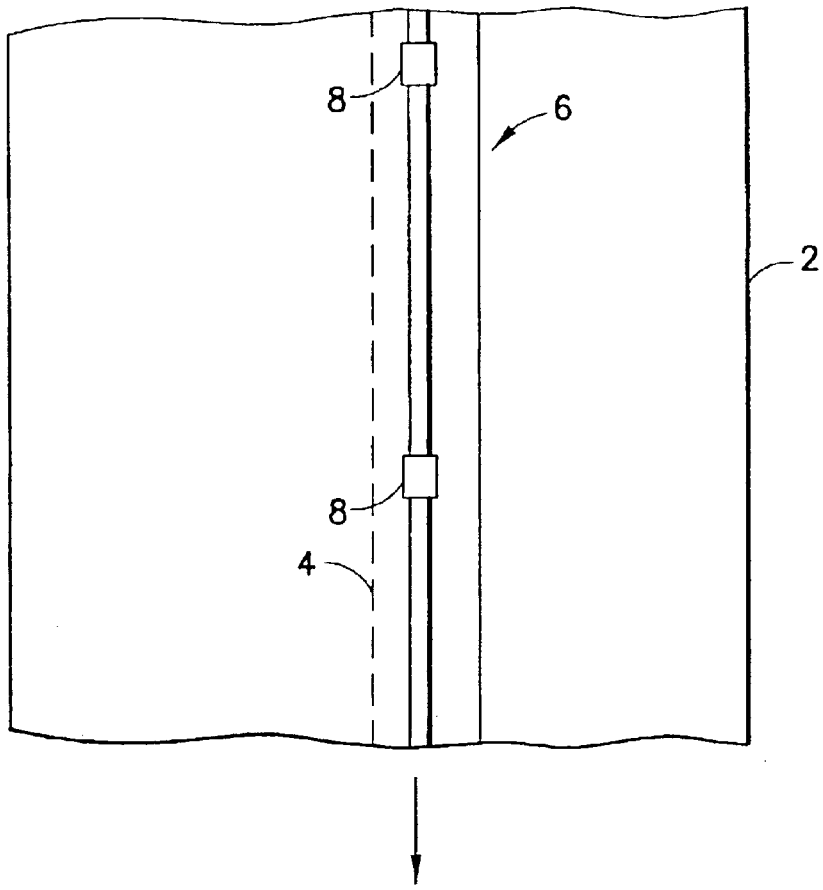
FIG. 3 is a drawing showing a split-flange slider-zipper assembly placed on a web of bag making film in accordance with one method of manufacturing the embodiment depicted in FIG. 2.

The method of manufacturing the resealable package depicted in FIG. 2 will now be described with reference to FIGS. 3–6. In the first stage of manufacture depicted in FIG. 3, a web of bag making film 2 is unwound from a roll and fed in a machine direction toward a horizontal form-fill-seal machine (not shown). The direction of web advancement is indicated by the arrow in FIG. 3. The web may be advanced one package increment or width at regular intervals of time. A zipper tape assembly 6 with sliders 8 inserted at spaced intervals therealong is guided to a position offset from the center of the web, indicated by dashed line 4, the zipper tape assembly being disposed parallel to the centerline 4. As will be explained below, the dashed line 4 in FIG. 3 is the location where the web 2 is folded. The slider-zipper assembly may be fed directly from a slider insertion machine or may be unwound from a spool of zipper tape having sliders pre-inserted thereon. As can be seen in FIG. 3, the zipper flanges are directed away from the centerline 4, with the zipper closure members being between the flanges and the web centerline.

While in the position shown in FIG. 3, the long flange 18 is joined to the bag making film by two-point heat sealing. This may be accomplished, for example, by pressing contacting portions of the zipper flange 18 and the bag making film between a heated sealing jaw 36 having two parallel spaced sealing bars and an opposing unheated sealing jaw or bed (not shown). Both jaws are retractable to allow intermittent sealing during the intervals when the web and zipper tape are not being advanced. The two bars of sealing jaw 36 are respectively positioned to form a band of heat sealing (permanent seal 34) between the short flange 32 and the bag making film 2 and a band of heat sealing (permanent seal 28) between the terminal section 26 of long flange 18 and the bag making film 2. The unheated jaw or bed (not shown) is pressed against flange 18 from above, while heated sealing jaw 36 is pressed against the bottom of the web of bag making film from below. The conditions of heat conduction are adjusted so that the flanges 18 and 32 are not sealed or tacked to each other. In accordance with this heat sealing arrangement, it is not necessary to form the flanges as laminates with mutually opposing high-melting-point non-sealant layers.

After the first heat sealing operation, the web of bag making film is folded over the zipper assembly at fold line 4 (see FIG. 3) by conventional means, e.g., a folding board or plow. After folding, the long flange 18 is joined to the opposing portions of the folded bag making film by two-point heat sealing. Again, this may be accomplished by pressing the zipper flanges and bag making film between a heated sealing jaw having two parallel spaced sealing bars and an opposing unheated sealing jaw or bed. This time, however, the positions of the heated and unheated sealing jaws are reversed relative to the zipper assembly. The end result is that respective bands of heat sealing (permanent seals 20 and 22 in FIG. 2) are formed between the long flange 18 and the bag making film 2.

In accordance with an alternative zipper application methodology, first the long flange is sealed at two points using a heated sealing jaw on one side and an unheated sealing jaw or bed on the other side in the manner described in U.S. patent application Ser. No. 10/262,087 filed Sep. 30, 2002 herewith and entitled "Method and Apparatus for Guiding and Sealing Split-Flange Zipper to Bag Making Film".

Figure 5:
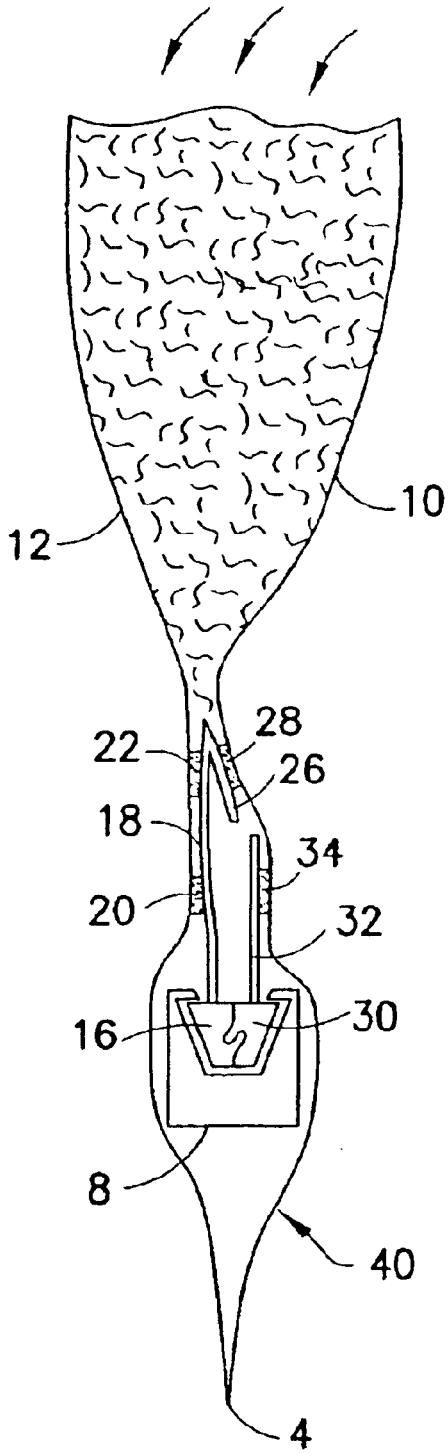
FIG. 5 is a drawing showing the resealable package being bottom-filled with product after the long zipper flange of the slider-zipper assembly has been two-point sealed to the folded-over portion of the web of bag making film.

At this juncture in the manufacturing process, the slider-zipper assembly is sealed inside a folded web, proximal to the fold, with the folded web upside-down in an upright position with the fold (i.e., the top of the package) at the bottom. The upside-down folded web is cross heat sealed after each advancement of web to form a respective package side seal. The vertical sealing bars (not shown) that make the cross seal may extend to the top of the header, to seal the ends of the header closed, or the sealing bars may stop at the zipper, leaving the ends of the header open. Each pair of successive cross seals produces a receptacle that is open at the top of the folded web of bag making film. The bottom of this receptacle (corresponding to the top of the completed package) is closed by the long zipper flange. The resulting receptacle is filled through its open top (which corresponds to the bottom of the completed package). In this sense, one can say that the zippered packages of the invention are filled from the bottom. Such filling is depicted in FIG. 5. After the package has been filled, the bottom of the package can be heat sealed in conventional fashion. Then the bag making film is cut along a side seal to separate the filled package from the web of bag making film.

Figure 7:
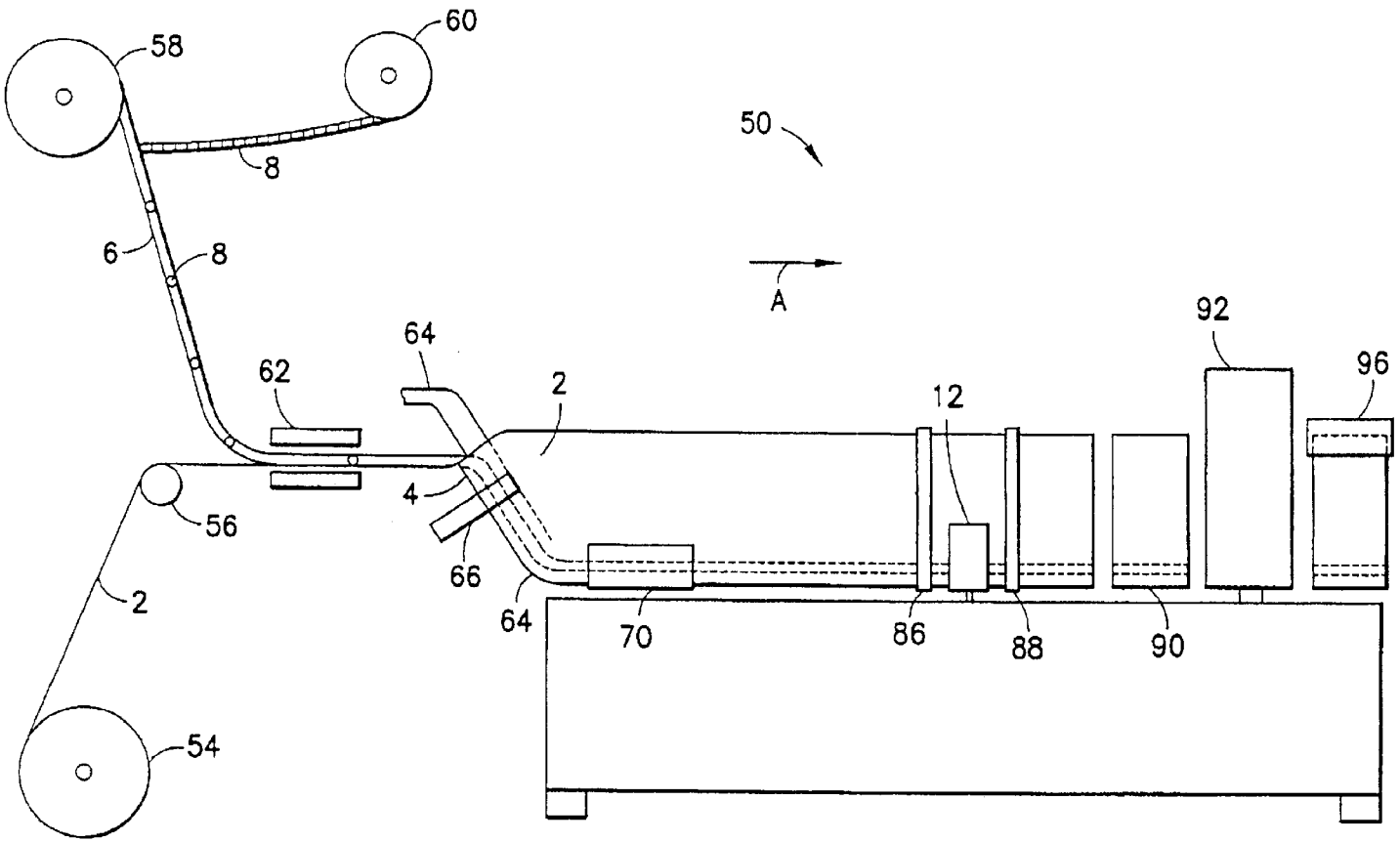
FIG. 7 is a drawing schematically representing an exemplary horizontal form-fill-seal machine for making a reclosable package of the type depicted in FIG. 2.

FIG. 7 shows a horizontal form-fill-seal (FFS) machine 50 that can be used to manufacture reclosable bags of the type shown in shown in FIG. 2. As seen in FIG. 7, a pull roller 52 of the FFS machine draws a continuous length of packaging film 2 dispensed from a supply roll 54 in a direction movement indicated by the arrow labeled A. As the packaging film 2 is dispensed in direction A, a flattening roller 56 positions the film on a horizontal plane. At the same time, a continuous length of interlocked zipper tape assembly 6 is unwound from a coil 58 and passed through a slider insertion device (not shown). Also a chain or series of sliders 8 is unwound from a coil 60 and fed to the slider insertion device. The slider insertion device inserts sliders onto the zipper tape at regular spaced intervals corresponding to the length of a zipper in each package.

Figure 4:
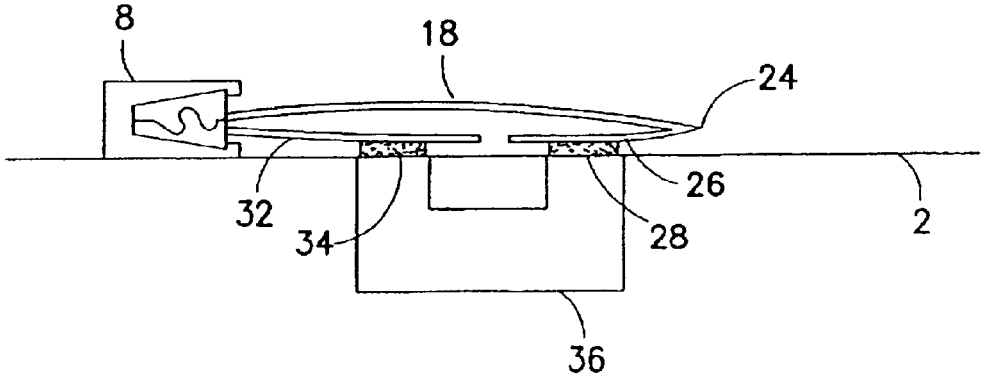
FIG. 4 is a drawing showing another step of the method of manufacture, the slider-zipper assembly being sealed at two points to the not-yet-folded bag making film after the placement step shown in FIG. 3.

The resulting slider-zipper assembly is placed on the bag making film 2 with the orientation shown in FIG. 4. As seen in FIG. 3, the continuous length of zipper tape assembly 6 with sliders 8 inserted thereon is longitudinally positioned on the packaging film 2 in parallel with and offset from a centerline 4 of the film where the film will be folded. At a first sealing station 62 (partly depicted in FIG. 4), permanent seals 28 and 34 are made by conduction heat sealing. These permanent seals and the mutual engagement of the zipper profiles maintain the alignment of the slider-zipper assembly with the centerline 4 (see FIG. 3) as the film with attached slider-tape assembly is drawn around a folder plow or board 64. The folder plow 64 folds the film 2 lengthwise down the centerline 4 of the film. As the packaging film 2 is fed over the folder plow 64, a perforator 66 perforates the film below the interlocking zipper profiles to form respective parallel lines of perforations (indicated by numerals 42 and 44 in FIG. 6). Alternatively, the perforator 66 can form a single line of perforations at the centerline. When folded, the packaging film 2 forms a bottom crease or fold at the centerline 4.

At a second sealing station 70, the permanent seals 20 and 22 are made as previously described. In additionally, the header seal 38 (see in FIG. 6) can be formed at the second sealing station 70 to provide a grasping surface at the crease 4 that will become the top of the final package. Still referring to FIG. 7, a cross sealing station 86 heat seals the opposing wall of the bag making film along a zone transverse to the direction of film movement, the seal zone having sufficient width to form respective side seals on successive packages when the seal zone is cut down the middle by cutter 88 (see below). The cross seals form discrete receptacle that can be filled before or after the cutting station. In the example shown in FIG. 7, individual packages 90 are cut from each other before filling. The individual packages 90 are conveyed to a filling station 92, where each package is filled through the open bottom of the upside-down package. After filling, the opposing film wall edges at the bottom of the filled package are sealed together at another sealing station 96, forming the bottom seal 14 depicted in FIG. 2.

By placing and sealing the slider-zipper assembly near the folding line of the web of bag making film, packagers of consumer products can avoid the process of filling product "behind" or "around" the zipper profiles, which can lead to product contamination on the zipper flanges, resulting in poor seal quality of the finished package.

Figure 6:
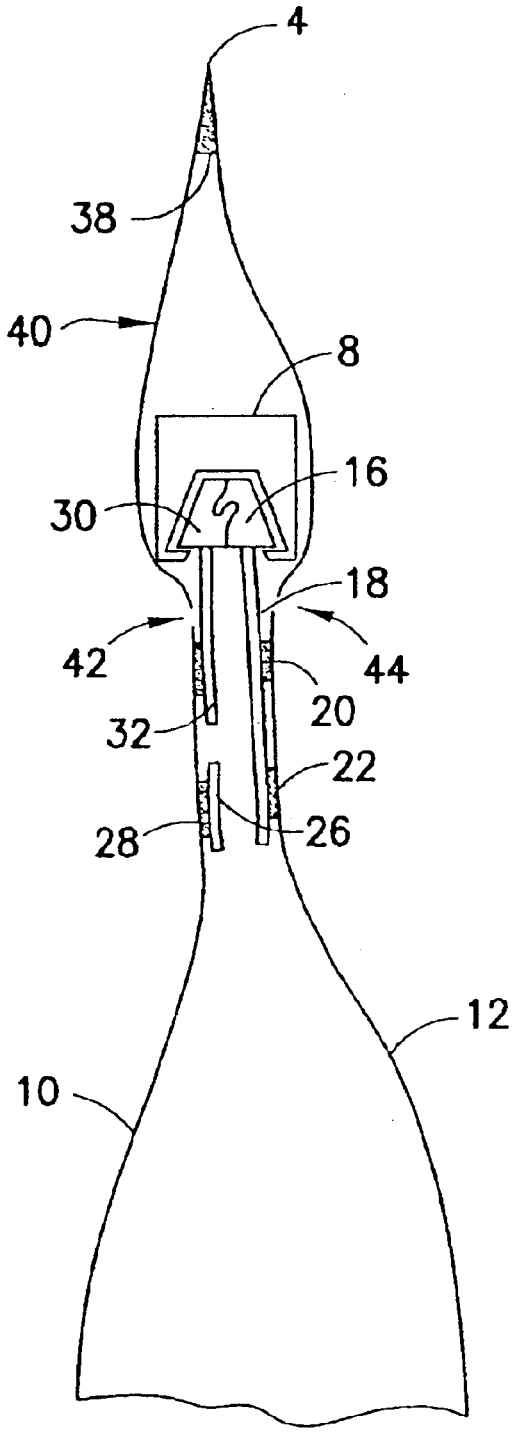
FIG. 6 is a drawing showing the areas where material in the resealable package must be ruptured or torn before the consumer can access the contents of the package.

To open the above-described package, the consumer must first remove the header, then operate the slider to open the zipper, and finally, rupture the long zipper flange along its tear line. To facilitate removal of the header, a reinforced section 38 (shown in FIG. 6) can be formed at the tip of the header by joining the walls 10 and 12 together, e.g., by heat sealing, in the region adjacent the fold line 4. This heat-sealed reinforced region can be easily gripped by the consumer to tear off the header 40. Tearing off of the header 40 is facilitated by providing respective tear lines, designated 42 and 44 in FIG. 6. Wall 10 has a tear line 42 located between the zipper closure element 30 and the seal 34, while wall 12 has a tear line 44 located between the zipper closure element 16 and the seal 20. Each tear line may consist of a line of spaced perforations, for example. After the header 40 has been torn away, the slider is moved in the opening direction to open the zipper. Then the consumer can reach in and rupture the long flange at the cusp of the V. FIG. 6 shows both the header separated from the package but not yet removed and the long flange ruptured, leaving the terminal section 26 of the long flange 18 attached to the wall 10, while the remainder of flange 18 is attached to the wall 12. Because the lowermost section of the ruptured long flange 18 is sealed to the wall 12 at seal 22, product inside the package cannot become trapped behind the flange 18 when the package is turned upside-down and product is dispensed.

FIG. 6 shows the areas where material in the resealable package must be ruptured or torn before the consumer can access the contents of the package. For the sake of economy, the rupture in the long zipper flange and the tears separating the header from the remainder of the package are all depicted in this single drawing, although a person skilled in the art will appreciate that the situation depicted would never occur in practice, since before the long flange could be ruptured, the header must already have been removed and the slider-operated zipper opened.

The disclosed embodiment is a four-point-sealed split-flange zipper attached to the bag making film near a fold line, with the resulting bag being filled from the bottom after four-point sealing has been finished. However, the broad concept of the sealing method disclosed herein encompasses sealing a long zipper flange and a short zipper flange to the bag making film before folding the film and then sealing the long zipper flange to the other side of the bag making film (along one or more zones of joinder) after folding. The zipper construction can be split flange or not. Moreover, in accordance with the broad concept of the invention, the zipper can be attached to the film near the fold line (as shown in FIG. 3) or near the edge of the film in order to manufacture the embodiments disclosed in U.S. Pat. No. 6,354,738. In the former case, the zipper will be sealed at the third point (or at the third and fourth points) prior to filling, whereas in the latter case, the zipper will be sealed at the third point (or at the third and fourth points) after filling. The apparatus shown in FIG. 7 can be modified when the zipper is attached near the edge of the web of bag making film by repositioning the first and second sealing stations 62 and 70 and the perforator 66 to account for the fact that the zipper assembly will now be located in the open top of the folded bag making film instead in the folded bottom of the bag making film (which folded bottom will become the top of the finished package). For example, the zipper assembly 6 shown in FIG. 3 would be translated away from the fold line 4 and toward the nearest edge of the web 2, in which case the first sealing station would need to be moved by an equal distance away from the center or fold line 4 of the web 2.

In addition, the zipper may be designed for slider-less operation, in which case pull flanges may be provided, extending upward from the interlockable profiled closure members.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "package" means a container, bag, pouch or other receptacle for objects, material or stuff. A container, bag, pouch or other receptacle is deemed to be a package even if not yet packed with objects, material or stuff. As used in the claims, the verb "joined" means fused, bonded, sealed, or adhered, whether by application of heat and/or pressure, application of ultrasonic energy, application of a layer of adhesive material or bonding agent, interposition of an adhesive or bonding strip, etc. As used in the claims, the term "wall" is used in a broad sense to include both a discrete piece of bag making material and a portion of a discrete piece of bag making material. Also, as used in the claims, the term "length" as applied to a zipper flange refers to the dimension of the zipper flange in a direction transverse to the longitudinal direction of the zipper.

What is claimed is:

1. A package comprising:

first and second walls; and a flexible zipper comprising first and second zipper parts that are mutually engageable to close said zipper and disengageable to open said zipper, said first zipper part comprising a first profiled closure element and a first flange having a first length, and said second zipper part comprising a second profiled closure element that is interlockable with said first closure element and a second flange having a second length greater than said first length, wherein a longitudinal portion of said first flange is joined to said first wall at a first seal, a first longitudinal portion of said second flange is joined to said first wall at a second seal, a second longitudinal portion of said second flange is joined to said second wall at a third seal, and a third longitudinal portion of said second flange is joined to said second wall at a fourth seal, said second seal being below said first seal, and said third seal being below said fourth seal, said second flange comprising a web of thermoplastic material having first and second sides, said second through fourth seals being on said first side of said second flange.

2. The package as recited in claim 1, further comprising a slider mounted to said zipper and configured to close portions of said zipper as said slider is moved in a first direction along said zipper and to open portions of said zipper as said slider is moved in a second direction along said zipper opposite to said first direction.

3. The package as recited in claim 1, wherein said first and second walls are connected along a fold line located above said zipper.

4. The package as recited in claim 3, wherein said first and second walls are joined adjacent said fold line to form a fifth seal.

5. The package as recited in claim 3, wherein said first wall has a tear line located between said first closure element and said first seal, and said second wall has a tear line located between said second closure element and said fourth seal.

6. The package as recited in claim 1, wherein said second flange has a tear line located between said first and second longitudinal portions of said second flange.

7. The package as recited in claim 1, wherein said first and second seals are generally parallel to each other, and said third and fourth seals are generally parallel to each other.

8. The package as recited in claim 1, wherein said second flange has a generally V-shaped portion that connects said first and second longitudinal portions of said second flange.

9. A package comprising:

a sheet of film folded along a fold line and sealed along its unfolded edges to form a bag body having opposing walls and an interior; and a flexible zipper joined to said opposing walls of film in proximity to said fold line, whereby said interior of said bag body is divided into a header space and a product space by joinder of said zipper and said opposing walls, said zipper comprising first and second zipper parts that are mutually engageable to close said zipper and disengageable to open said zipper, said first zipper part comprising a first profiled closure element and a first flange having a first length, and said second zipper part comprising a second profiled closure element that is interlockable with said first closure element and a second flange having a second length greater than said first length, wherein one side of said first flange is joined to one wall of said bag body and one side of said second flange is joined to both walls of said bag body in a manner that closes said product space, wherein said second flange comprises a first portion joined to said one wall along a first seal, a second portion joined to the other wall along a second seal, and a third portion joined to said other wall along a third seal, said second and third seals being generally mutually parallel and separated by an unsealed region of said second flange.

10. The package as recited in claim 9, wherein said second flange comprises a tear line located between said first and second portions of said second flange.

11. The package as recited in claim 10, wherein said second flange has a generally V-shaped portion that connects said first and second portions of said second flange, said tear line being located at a cusp of said generally V-shaped portion.

12. The package as recited in claim 9, further comprising a slider mounted to said zipper and configured to close portions of said zipper as said slider is moved in a first direction along said zipper and to open portions of said zipper as said slider is moved in a second direction along said zipper opposite to said first direction, said slider being disposed in said header space.

13. The package as recited in claim 9, wherein opposing portions of said sheet of film are joined to each other adjacent said fold line to form a header seal.

14. The package as recited in claim 13, wherein said film is a laminate comprising a first layer of low-melting-point sealant thermoplastic material and a second layer of higher-melting-point thermoplastic material, said first layer facing said interior of said bag body.

15. The package as recited in claim 9, wherein a first portion of said film on one side of said fold line has a first tear line, and a second portion of said film on the other side of said fold line has a second tear line, said first and second portions of said film defining said header space.

* * * * *